US010787977B2

(12) United States Patent
Wodausch et al.

(10) Patent No.: US 10,787,977 B2
(45) Date of Patent: Sep. 29, 2020

(54) METHOD FOR OPERATING A COMBUSTION MACHINE, COMBUSTION MACHINE AND MOTOR VEHICLE

(71) Applicant: VOLKSWAGEN AKTIENGESELLSCHAFT, Wolfsburg (DE)

(72) Inventors: Jens Wodausch, Braunschweig (DE); Björn Fröhlich, Gifhorn (DE); Silke Weddig, Braunschweig (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/210,702

(22) Filed: Dec. 5, 2018

(65) Prior Publication Data

US 2019/0178179 A1 Jun. 13, 2019

(30) Foreign Application Priority Data

Dec. 13, 2017 (DE) ..... 10 2017 129 769

(51) Int. Cl.
*F02D 41/00* (2006.01)
*F02M 25/08* (2006.01)

(52) U.S. Cl.
CPC ..... *F02D 41/0045* (2013.01); *F02D 41/0042* (2013.01); *F02M 25/089* (2013.01);
(Continued)

(58) Field of Classification Search
CPC ..... F02D 41/0045; F02D 41/0042; F02D 41/263; F02D 2200/0602; F02M 25/0836;
(Continued)

(56) References Cited

U.S. PATENT DOCUMENTS

2002/0162457 A1 11/2002 Hyodo et al.
2003/0047161 A1 3/2003 Bagnasco et al.
(Continued)

FOREIGN PATENT DOCUMENTS

DE 10 2005 013 918 A1 10/2005
DE 10 2015 216504 A1 3/2017
(Continued)

OTHER PUBLICATIONS

Search report for European Patent Application No. 18210319.2, dated Apr. 23, 2019.
(Continued)

*Primary Examiner* — George C Jin
(74) *Attorney, Agent, or Firm* — Pearl Cohen Zedek Latzer Baratz LLP

(57) ABSTRACT

A method is provided to determine the hydrocarbon content in the purge gas of a fuel tank system of a combustion machine, whereby the fuel tank system comprises at least a fuel tank, a fuel vapor filter that is fluidically connected to an atmospheric port, a vent line leading from the fuel tank to the fuel vapor filter, a purge gas line leading from the fuel vapor filter to the fresh gas line of the combustion machine, a fuel tank vent valve that is integrated into the purge gas line, a pressure sensor that is integrated into the purge gas line and that can be configured as an absolute pressure sensor or as a differential pressure sensor, and a compressor that is integrated into the purge gas line. In this context, it is provided that, during operation of the compressor, at least three pressure measurements are carried out in the purge gas line over a defined period of time by means of the pressure sensor and, only at the end of this period of time, on the basis of the determined pressure values, the loading of the purge gas with hydrocarbons is qualitatively determined in the purge gas that had flowed through the purge gas line during
(Continued)

Figure 1:
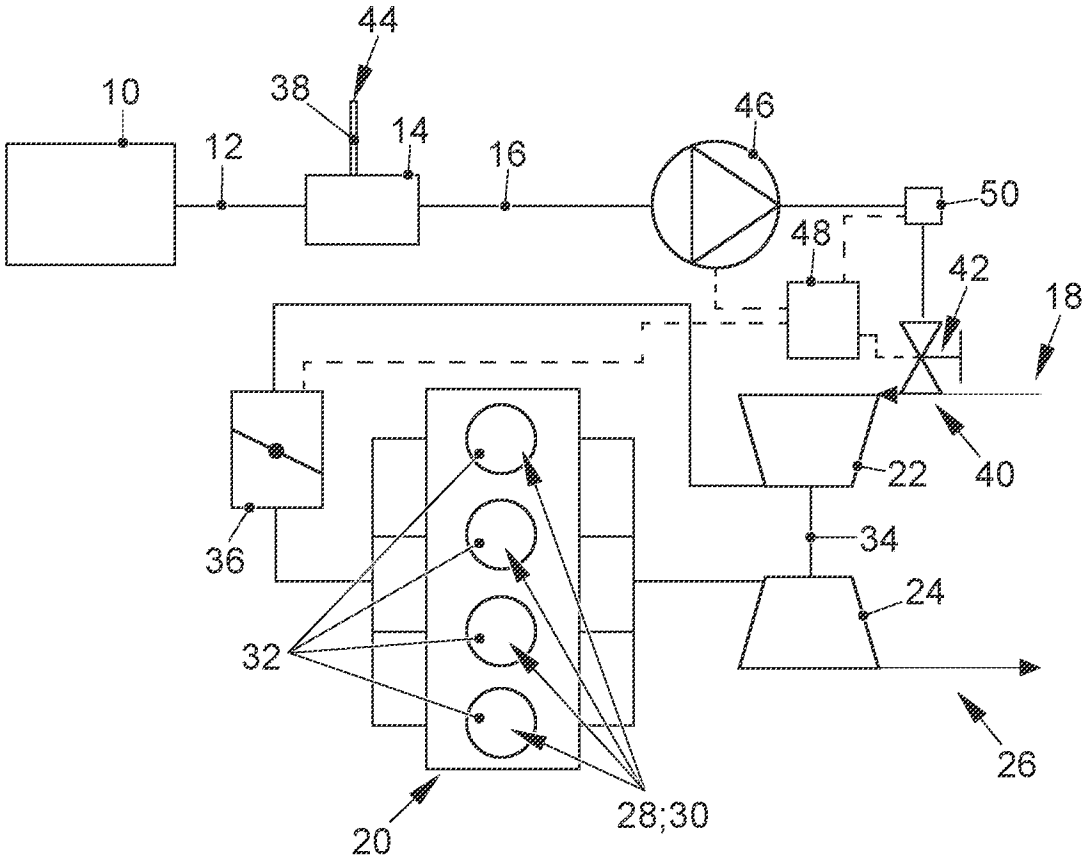

the period of time. Aside from the determination of the quantitative loading, which is preferably carried out parallel to the determination of the qualitative loading, the determination according to the invention of the qualitative loading allows a very precise assessment of the influence that the purge gas—which is fed to the fresh gas line of the combustion machine and from there to the internal combustion engine—exerts on the combustion processes during operation of the internal combustion engine.

10 Claims, 2 Drawing Sheets

(52) U.S. Cl.
CPC . *F02M 25/0836* (2013.01); *F02D 2200/0602* (2013.01); *F02D 2200/0612* (2013.01)

(58) Field of Classification Search
CPC ..... F02M 25/089; F02M 25/0809; F02M 25/0827; F02M 25/0872; B01D 53/0454; B01D 53/0446; B01D 2257/7022; B01D 2259/4516
See application file for complete search history.

(56) References Cited

U.S. PATENT DOCUMENTS

| | | | | |
|---|---|---|---|---|
| 2005/0211228 | A1* | 9/2005 | Amano | F02M 25/0809 123/520 |
| 2007/0246024 | A1* | 10/2007 | Sato | F02M 25/0809 123/520 |
| 2008/0092858 | A1 | 4/2008 | Satoh et al. | |
| 2011/0247595 | A1* | 10/2011 | Ogita | F02M 25/089 123/521 |
| 2017/0159588 | A1 | 6/2017 | Honjo | |
| 2018/0066595 | A1* | 3/2018 | Dudar | F02D 41/0037 |

FOREIGN PATENT DOCUMENTS

| | | | |
|---|---|---|---|
| DE | 10 2016 014 461 | A1 | 6/2017 |
| DE | 10 2016 014461 | A1 | 6/2017 |
| JP | 3 998744 | B2 | 10/2007 |

OTHER PUBLICATIONS

Search report for German Patent Application No. 10 2017 129 769.3, dated Jun. 26, 2018.

* cited by examiner

METHOD FOR OPERATING A COMBUSTION MACHINE, COMBUSTION MACHINE AND MOTOR VEHICLE

CROSS-REFERENCE TO RELATED APPLICATIONS

This application claims priority from German Patent Application No. 10 2017 129 769.3, filed Dec. 13, 2017, which is hereby incorporated by reference.

FIELD OF THE INVENTION

The invention relates to a method for operating a combustion machine having a fuel tank system that comprises a fuel tank vent valve. The invention also relates to a combustion machine that is suitable for carrying out such a method as well as to a motor vehicle having such a combustion machine.

BACKGROUND OF THE INVENTION

As a rule, a fuel tank system for a combustion machine of a motor vehicle has a vent line so that a rising pressure in the fuel tank of the tank system caused, for instance, by fuel that is evaporating at high ambient temperatures can be relieved to the atmosphere. In this process, also in view of the emissions standards, only the smallest possible amounts of fuel vapors are allowed to escape into the environment. This is prevented in that a fuel vapor filter, which is usually configured in the form of an activated carbon filter that absorbs the fuel vapors, is integrated into the vent line.

In order to regenerate such a fuel vapor filter, such a tank system is additionally provided with a purge gas line which is connected, on the one hand, to the fuel vapor filter and, on the other hand, to the fresh gas line of the combustion machine. During operation of the combustion machine, ambient air can at times be drawn in via an atmospheric port of the fuel vapor filter by means of the negative pressure that prevails in the area of the opening of the purge gas line, and this ambient air flows through the fuel vapor filter in the direction opposite to the direction in which the fuel vapors are flowing out of the fuel tank and into the fuel vapor filter, thus purging the filter. In this manner, the fuel vapors from the fuel vapor filter are fed via the fresh gas line to the combustion chambers of the internal combustion engine of the combustion machine.

U.S. Pat. Appln. No. 2003/0047161 A1 discloses a fuel tank system of a combustion machine having a direct-injection gas engine in which the type of combustion process and the amount of fuel injected during the purging of the fuel tank system are set as a function of a target value deviation for the fuel-to-air ratio, said deviation being determined on the basis of the measured value of a lambda sensor.

U.S. Pat. Appln. No. 2002/0162457 A1 describes a method for venting a fuel tank system of a combustion machine, whereby, on the basis of the hydrocarbon (HC) content in the purge gas, a decision is made as to when the fuel vapor filter has to be purged and when this purging can be ended again. In this context, the hydrocarbon content in the purge gas is determined by means of an appropriate HC sensor.

SUMMARY OF THE INVENTION

The invention was based on the objective of putting forward an advantageous method for determining the hydrocarbon content in the purge gas of a fuel tank system of a combustion machine.

This objective is achieved by means of a method according to patent claims. A combustion machine that is suitable for carrying out such a method is the subject matter of patent claims. Advantageous embodiments of the method according to the invention and preferred embodiments of the combustion machine according to the invention are the subject matters of the other patent claims and/or they ensue from the description of the invention below.

According to the invention, a method to determine the hydrocarbon content in the purge gas of a fuel tank system of a combustion machine is being provided, whereby the fuel tank system comprises at least

- a fuel tank,
- a fuel vapor filter that is fluidically connected to an atmospheric port,
- a vent line leading from the fuel tank to the fuel vapor filter,
- a purge gas line leading from the fuel vapor filter to the fresh gas line of the combustion machine,
- a control valve (fuel tank vent valve) that is integrated into the purge gas line,
- a pressure sensor that is integrated into the purge gas line and that can be configured as a relative pressure sensor or as an absolute pressure sensor or as a differential pressure sensor, and
- a compressor, that is to say, a so-called purge air pump, that is integrated into the purge gas line.

It is provided according to the invention that, during operation of the compressor, at least three pressure measurements are carried out by means of the pressure sensor in the purge gas line over a defined period of time and, only at the end of this period of time, on the basis of the determined pressure values, the loading of the purge gas with hydrocarbons is qualitatively determined in the purge gas that had flowed through the purge gas line during the period of time.

In this context, the expression determining the "qualitative" loading refers to the fact that at least one statement is made about the concrete composition of some of the hydrocarbons in the mixture of hydrocarbons contained in the purge gas.

The term "fuel vapor filter" does not mean according to the invention that it has to filter the volatile fuel in gaseous form. Rather, the fuel can already have (partially) condensed out again during the filtering procedure.

Aside from the determination of the quantitative loading, which is preferably carried out parallel to the determination of the qualitative loading, the determination according to the invention of the qualitative loading allows a very precise assessment of the influence that the purge gas—which is fed to the fresh gas line of the combustion machine and from there to the internal combustion engine—exerts on the combustion processes during operation of the internal combustion engine. As a result, countermeasures can thus be carried out very precisely such as, for instance, adjusting the amount of fuel that is injected into the combustion chambers of the internal combustion engine for the individual work cycles, and this adjustment serves to compensate for the hydrocarbons that are introduced into the combustion chambers along with the purge gas. In this manner, the fuel-fresh gas mixtures that are thermally converted in the combustion chambers during the individual work cycles can be kept very exactly within the range of a prescribed target value or within a target value range, and this has a positive impact on the operating behavior of the internal combustion engine or of the entire combustion machine, and especially on the volumetric efficiency and/or on the emission behavior.

Accordingly, the invention also relates to a method for operating a combustion machine, said method encompassing the determination according to the invention of the hydrocarbon content in the purge gas of a fuel tank system of the combustion machine and, based on the result of this determination, encompassing the adjustment of parameters that influence combustion processes that take place in an internal combustion engine during operation of the combustion machine.

The preferably quantitative determination of the loading of the purge gas with hydrocarbons—a procedure in which preferably the amount of the hydrocarbons in relation to the total amount of purge gas, that is to say, the relative hydrocarbon content (in percent by volume or in percent by weight) is determined—preferably takes place only or one time (for the period of time) at the end of the period of time, as a result of which, based on pressure measurements, very precise results can be obtained pertaining to the quantitative loading of the purge gas with hydrocarbons.

It can preferably be provided that the defined period of time begins with the start-up of the compressor, and thus with the beginning of a purging procedure, and/or that it ends with the determination of several pressure values that are within the same value range. In this context, this value range is relatively small in comparison to the maximum difference among the measured pressure values, so that it is thus provided that the defined period of time ends when pressure values that are the same or approximately the same occur multiple times. As an alternative or in addition, however, it can also be provided that the defined period of time extends precisely to, or at least over, the defined number of pressure measurements.

In accordance with a preferred embodiment of a method according to the invention, it can be provided that, for the pressure measurements, in each case, a pressure gradient, a pressure differential relative to one of the other pressure measurements and/or a pressure gradient differential is determined, which are then analyzed with respect to at least one of these descriptive values that is characteristic of certain types of hydrocarbons in order to qualitatively determine the loading of the purge gas with hydrocarbons. In this manner, it can be provided, for example, that, in the case of a relatively large pressure gradient, the presence of a relatively high content of ethanol in the purge gas can be assumed.

It can likewise be preferably provided that the positions of at least some of the pressure measurements taken within the defined period of time and/or the time interval of at least some of the pressure measurements taken during a preceding start-up of the compressor are used in order to determine the qualitative loading of the purge gas with the hydrocarbons. This yields a very precise determination of the qualitative loading. For example, it can be provided that a relatively high content of ethanol in the purge gas is only assumed if a relatively large pressure gradient has been determined within a relatively early segment of the defined period of time and especially after the compressor has been started up.

In order to enhance the precision of the determination of the quantitative and/or qualitative loading of the purge gas with hydrocarbons, it can preferably be provided that the time interval between the pressure measurements is varied, at least at times. In particular, it can be provided that, within defined limits and relative to reference values, the larger a pressure gradient determined on the basis of the first pressure measurement is, the shorter the time interval selected between a first pressure measurement and a second pressure measurement. Consequently, it can preferably be provided that a first pressure gradient is determined on the basis of a first pressure measurement and a second pressure gradient is determined on the basis of a subsequent second pressure measurement, and, on the basis of the magnitude of the difference between these pressure gradients, the time interval between the second and a subsequent third pressure measurement is varied in such a way that a relatively small time interval is selected in the case of a relatively large difference between the pressure gradients.

It can preferably be provided that a method according to the invention is carried out at least once for each start-up of the compressor, so that, for each purging procedure, a determination according to the invention is made of the hydrocarbon content in the purge gas that is then being conveyed, so that, for each purging procedure, it is accordingly possible to carry out the most exact compensation possible of the influence exerted by the hydrocarbons that have been introduced via the purge gas into the combustion chambers of the internal combustion engine.

A combustion machine according to the invention comprises, on the one hand, at least

- an internal combustion engine,
- a fresh gas line for feeding fresh gas to the internal combustion engine,
- an exhaust gas line for discharging exhaust gas from the internal combustion engine, and
- a fuel tank system that comprises
  - a fuel tank,
  - a fuel vapor filter that is fluidically connected to an atmospheric port,
  - a vent line leading from the fuel tank to the fuel vapor filter,
  - a purge gas line leading from the fuel vapor filter to the fresh gas line of the combustion machine,
  - a control valve (fuel tank vent valve) that is integrated into the purge gas line,
  - a pressure sensor that is integrated into the purge gas line, and
  - a compressor, that is to say, a so-called purge air pump, that is integrated into the purge gas line.

Moreover, a combustion machine according to the invention has a control device that is configured to automatically carry out a method according to the invention.

The method according to the invention can especially be employed in a fuel tank system of a combustion machine (according to the invention) whose internal combustion engine can be operated in an externally ignited manner, especially in accordance with the Otto principle, since the fuel used to operate such an internal combustion engine is usually relatively highly volatile (especially in comparison to diesel fuel), as a result of which the special need for a fuel tank vent system can be warranted.

A combustion machine according to the invention can especially be part of a motor vehicle. In this context, the internal combustion engine of the combustion machine can especially be designed to directly or indirectly provide the drive power for the motor vehicle. Therefore, the invention also relates to a motor vehicle, particularly to a motor vehicle on wheels (preferably a passenger car or a truck) having a combustion machine according to the invention.

The indefinite articles ("a", "an"), especially in the patent claims and in the description that generally explains the patent claims, are to be understood as such and not as numbers. Therefore, components described in a concrete manner should be understood in such a way that they are present at least once and can also be present several times.

DETAILED DESCRIPTION OF THE DRAWINGS

Figure 2:
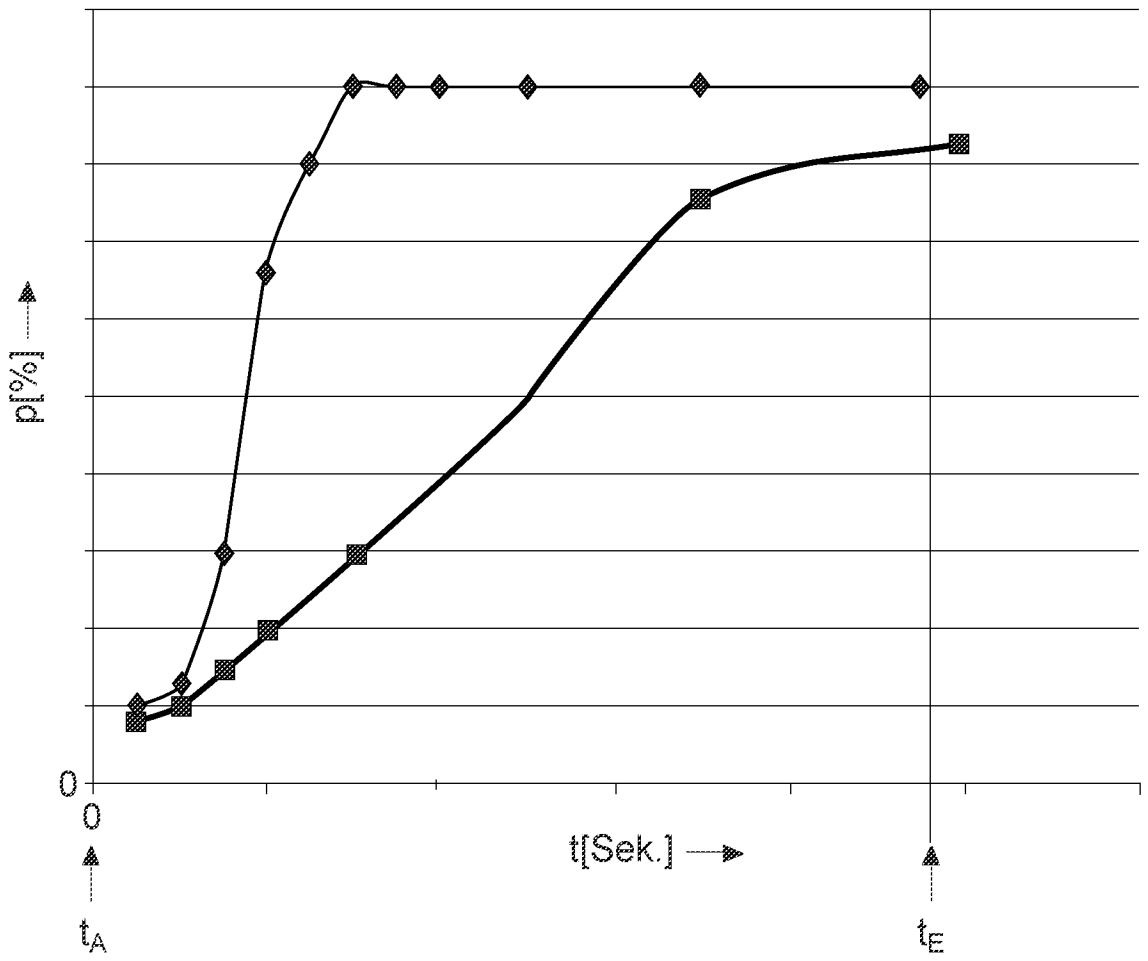

The invention will be explained in greater detail below, making reference to an embodiment shown in the drawings. The drawings show the following:

FIG. 1: a combustion machine according to the invention, having a fuel tank system, in a schematic depiction, and FIG. 2: a diagram illustrating the execution of a method according to the invention.

DETAILED DESCRIPTION OF THE INVENTION

FIG. 1 shows a combustion machine according to the invention for a motor vehicle having a fuel tank system. This system comprises a fuel tank 10 that is connected via a vent line 12 to a fuel vapor filter 14 which especially can be configured in the form of an activated carbon filter or which at least comprises such a filter. The fuel vapor filter 14 is also connected via a purge gas line 16 to a fresh gas line 18 of the combustion machine, whereby the purge gas line 16 opens up into the fresh gas line 18 upstream (relative to the flow direction of fresh gas in the fresh gas line 18 in the direction of an internal combustion engine 20 of the combustion machine) of a charge-air compressor 22 that is integrated into the fresh gas line 18. The charge-air compressor 22 is part of an exhaust-gas turbocharger that also comprises an exhaust-gas turbine 24 that is integrated into an exhaust gas line 26 of the combustion machine. In the charge-air segment of the fresh gas line 18 located between the charge-air compressor 22 and the internal combustion engine 20, there is also a throttle valve 36 that divides the charge-air segment into an upstream section, which is often referred to as a pressure pipe, and a downstream section, which is often referred to as an intake pipe.

During operation of the combustion machine, in a known manner, gas mixtures consisting of fresh gas that is made up completely or primarily of ambient air and of fuel that is injected, for example, directly into the combustion chambers 28 by means of injection valves (not shown here) are burned in a defined sequence in the combustion chambers 28 of the internal combustion engine 20, said chambers being partially delimited by cylinders 30 of the internal combustion engine 20, whereby the pressure rises thus generated in the combustion chambers 28 are used to move pistons 32 that can be moved along the longitudinal axis in the cylinders 30. Through the interaction of connecting rods (not shown here), these movements of the pistons 32 can be converted into a rotational motion of a crankshaft (not shown here), whereby the movement of the pistons 32 via the connecting rods by means of the crankshaft simultaneously brings about a cyclical back-and-forth movement of the pistons 32. The exhaust gas generated in the combustion chambers 28 during the combustion of the fuel-fresh gas mixtures is discharged via the exhaust gas line 26, thereby flowing through the exhaust gas turbine 24, which causes a turbine impeller (not shown here) to rotate. This rotation of the turbine impeller is transferred by means of a shaft 34 to a compressor impeller (not shown here) of the charge air compressor 22, as a result of which the charge air compressor 22 compresses the fresh gas that is fed to the internal combustion engine 20 via the fresh gas line 18.

The side of the fuel vapor filter 14 of the fuel tank system facing away from the vent line 12 and the purge gas line 16 (with respect to its filtering effect for fuel vapors) is fluidically connected to the atmosphere via an ambient air line 38, for which purpose the ambient air line 38 forms an atmospheric port 44.

The fuel tank 10 is partially filled with fuel, whereby a part of this fuel, which is actually liquid, has usually evaporated, so that fuel in a gaseous state of aggregation is also present in the fuel tank 10. Such an evaporation of fuel in the fuel tank 10 is intensified by a relatively high temperature of the fuel, and this can occur especially at relatively high ambient temperatures as well as in the case of a change in the ambient pressure, for instance, if a motor vehicle comprising the combustion machine is being driven up a mountain. In order to prevent an impermissibly high excess pressure in the fuel tank 10 due to such evaporation, the possibility exists to equalize the pressure with the ambient pressure via the vent line 12 and the fuel vapor filter 14 as well as via the ambient air line 38, whereby the fuel vapor filter 14 prevents such a pressure equalization from allowing fuel vapors to escape into the environment.

Such a venting of the fuel tank 10 leads to an increasing saturation of the fuel vapor filter 14 which, in turn, requires the filter to be regenerated at regular intervals. For this purpose, it is provided for the fuel vapor filter 14 to be purged in that ambient air is drawn in via the atmospheric port 44 and via the ambient air line 38. This ambient air flows through the fuel vapor filter 14 in the opposite direction from that of the flow during the venting of the fuel tank 10, as a result of which fuel molecules absorbed in the fuel vapor filter 14 are carried along by the ambient air and introduced into the fresh gas line 18 via the purge gas line 16. Consequently, this fuel, which usually contains a mixture of different hydrocarbons, is conveyed to the combustion chambers 28 of the internal combustion engine 20 in order to be burned.

Such a purging of the fuel vapor filter 14 is only provided for at times and always during operation of the internal combustion engine 20 because only then can the fuel that has been introduced into the fresh gas line 18 by the purging of the fuel vapor filter 14 also be reliably fed into the combustion chambers 28 in order to be burned. In contrast, if fuel is introduced into the fresh gas line 18 when the internal combustion engine 20 is not being operated, this could cause the gaseous fuel to escape into the environment via leaks in the fresh gas line 18 and especially via an intake opening of the fresh gas line 18.

A fuel tank vent valve 42 that is integrated into the purge gas line 16 is arranged as close as possible to the purge gas line opening 40 leading into the fresh gas line 18, or else it is integrated into it.

In order to purge the fuel vapor filter 14, there is a need for a sufficient pressure gradient between, on the one hand, the ambient pressure and, on the other hand, the pressure in the fresh gas line 18 in the vicinity of the opening 40 of the purge gas line 16, whereby this pressure gradient is not always present due to greatly fluctuating pressures in the fresh gas line 18 during operation of the internal combustion engine 20. During operation of the internal combustion engine 20 and thus of the charge air compressor 22, the pressure of the fresh gas in the section of the fresh gas line 18 in the area of the opening 40 of the purge gas 16 is usually so low that there is a sufficient pressure gradient relative to the ambient pressure that is present at the atmospheric port 44. However, this is not always the case.

In order to allow purging of the fuel vapor filter 14 at any time so that its complete saturation can be reliably prevented, the fuel tank system of the combustion machine also comprises a compressor 46 that is integrated into the purge gas line 16, whereby said compressor 46 is also normally referred to as a "purge air pump" and it can be configured in the form of a piston compressor, especially as a rotary vane compressor or else as a radial fan. When this compressor 46 is being operated, ambient air can be actively drawn in via the atmospheric port 44, and this air then flows through the fuel vapor filter 14 in order to purge it, and is then conveyed via the compressor 46 all the way to the opening 40 of the purge gas line 16.

At least the compressor 46, the fuel tank vent valve 42, the throttle valve 36 and a pressure sensor 50 that is integrated into the purge gas line 16 can be actuated by means of a control device 48 (for example, the engine control unit of the combustion machine).

FIG. 2 is a diagram illustrating the procedure when the method according to the invention is being carried out. In this figure, for two purging procedures of a fuel tank system of a combustion machine according to the invention as shown, for example, in FIG. 1, the pressure curves in a section of the purge gas line 16, which can especially be arranged downstream from the compressor 46, are plotted over time for a defined period of time that begins with the start-up of the compressor (initial point in time $t_A$) and that extends over a time span until the end point in time $t_E$ depicted in FIG. 2. During this defined period of time, multiple pressure measurements are carried out for each one of the purging procedures, and these measurements are depicted in FIG. 2 by appropriate measuring points along the pressure curves, and the associated pressure curves are interpolated on the basis of the measured pressure values. The end point in time $t_E$, which can also be different for the various purging procedures, can be a defined time span after the appertaining initial point in time $t_A$. As an alternative, it can be provided for the end point in time $t_E$ to coincide with the execution of the last of a defined number of pressure measurements. And, in turn, it can be alternatively provided that the end point in time $t_E$ is set when the specific pressure curve under consideration no longer changes—or else only by a value that is below a defined limit value—over a defined period of time and/or over a defined number of pressure measurements.

At the same time as the end of the defined period of time, an evaluation is made of the pressure curve or of each pressure curve, on the basis of which it is possible to derive, on the one hand, the quantitative and, on the one hand, the qualitative, loading of the purge gas that is being conveyed by the compressor during the appertaining period of time and that is subsequently flowing or already has flowed into the fresh gas line, together with hydrocarbons. This evaluation is especially based on the fact that the various hydrocarbons contained in the purge gas exhibit different densities, on the one hand, in comparison to each other and, on the other hand, in comparison to ambient air that is likewise contained in the purge gas. In this context, on the basis of the averaged rise in the pressure over the appertaining period of time, especially the quantitative loading of the purge gas with hydrocarbons can be determined, whereas on the basis of the characteristic curve of the pressure during the appertaining period of time, conclusions can be drawn about the qualitative loading and thus about the composition of the mixture containing various hydrocarbons in the purge gas. For instance, the upper pressure curve of the two curves depicted in FIG. 2 exhibits a clearly steeper rise in a relatively early section of the defined period of time than the lower pressure curve in a corresponding section of the associated period of time, as a result of which a relatively high content of ethanol in the purge gas being conveyed in the corresponding purging procedure can be derived.

FIG. 2 also shows that the time intervals between the pressure measurements for the individual pressure curves are varied, whereby as a tendency, it is provided that the steeper the rise or the larger the pressure gradient at the point in time of each preceding pressure measurement was, the shorter the time interval that is selected after which a pressure measurement that still has to be carried out is actually carried out. This enhances the resolution during the determination of the pressure curves and thus improves the evaluation result.

LIST OF REFERENCE NUMERALS

10 fuel tank
12 vent line
14 fuel vapor filter
16 purge gas line
18 fresh gas line
20 internal combustion engine
22 charge air compressor
24 exhaust gas turbine
26 exhaust gas line
28 combustion chamber of the internal combustion engine
30 cylinder of the internal combustion engine
32 piston of the internal combustion engine
34 shaft
36 throttle valve
38 ambient air line
40 opening of the purge gas line
42 fuel tank vent valve
44 atmospheric port
46 compressor
48 control device
50 pressure sensor

The invention claimed is:

1. A method to determine the hydrocarbon content in the purge gas of a fuel tank system of a combustion machine having a fuel tank, a fuel vapor filter that is fluidically connected to an atmospheric port, a vent line leading from the fuel tank to the fuel vapor filter, a purge gas line leading from the fuel vapor filter to the fresh gas line of the combustion machine, a control valve that is integrated into the purge gas line, a pressure sensor that is integrated into the purge gas line, and a compressor that is integrated into the purge gas line, the method comprising:

carrying out, during operation of the compressor, at least three pressure measurements over a defined period of time by means of the pressure sensor and, qualitatively determining, at the end of the defined period of time, on the basis of pressure values determined by the at least three pressure measurements, the loading of the purge gas with hydrocarbons.

2. The method according to claim 1, wherein the defined period of time begins with the start-up of the compressor and/or ends with the determination of several pressure values that are within the same value range, and/or the defined period of time extends over the defined number of pressure measurements.

3. The method according to claim 1, wherein, for the pressure measurements, in each case, a pressure gradient and/or a pressure differential relative to one of the other pressure measurements and/or a pressure gradient differential is determined, which are then analyzed with respect to at least one of these individually descriptive values that is characteristic of certain types of hydrocarbons in order to qualitatively determine the loading of the purge gas with hydrocarbons.

4. The method according to claim 1, wherein the positions of the pressure measurements taken within the defined period of time and/or a time-lag between the pressure measurements taken and a preceding start-up of the compressor are used in order to determine the qualitative loading of the purge gas with the hydrocarbons.

5. The method according to claim 1, wherein, at the end of the period of time, the loading of the purge gas with hydrocarbons is also quantitatively determined (one time) on the basis of the measured pressure values.

6. The method according to claim 1, wherein the time interval between the pressure measurements is varied, at least at times.

7. The method according to claim 6, wherein carrying out at least three pressure measurements comprises:

determining a first pressure gradient on the basis of a first pressure measurement and determining a second pressure gradient on the basis of a subsequent second pressure measurement, and on the basis of the magnitude of the difference between the first and second pressure gradients, varying the time interval between the second and a subsequent third pressure measurement in such a way that a relatively small time interval is selected in the case of a relatively large difference between the first and second pressure gradients.

8. The method according to claim 1, wherein the method is executed every time the compressor is started up.

9. A combustion machine, comprising an internal combustion engine, a fresh gas line for feeding fresh gas to the internal combustion engine, an exhaust gas line for discharging exhaust gas from the internal combustion engine, a fuel tank system that comprises a fuel tank, a fuel vapor filter that is fluidically connected to an atmospheric port, a vent line leading from the fuel tank to the fuel vapor filter, a purge gas line leading from the fuel vapor filter to the fresh gas line of the combustion machine, a control valve that is integrated into the purge gas line, a pressure sensor that is integrated into the purge gas line, and a compressor that is integrated into the purge gas line, and a control device configured to automatically carry out the method according to claim 1.

10. A combustion machine according to claim 9, wherein the internal combustion engine can be operated in an externally ignited manner.

* * * * *